United States Patent [19]

Destry et al.

[11] Patent Number: 4,889,346

[45] Date of Patent: Dec. 26, 1989

[54] AUTOMATED TARGET RANGE SYSTEM

[75] Inventors: Donald M. Destry, Palatine, Ill.; Christopher M. Destry, Carmel, Ind.

[73] Assignee: Computer Design Ranges, Inc., Palatine, Ill.

[21] Appl. No.: 185,969

[22] Filed: Apr. 25, 1988

[51] Int. Cl.[4] ..... F41J 7/02

[52] U.S. Cl. ..... 273/406

[58] Field of Search ..... 273/406, 370, 369; 104/89, 95, 91, 106; 105/148, 154; 191/12 R, 23 A, 23 R

[56] References Cited

U.S. PATENT DOCUMENTS

| | | | |
|---|---|---|---|
| 2,772,092 | 11/1956 | Nikoden | 273/410 |
| 3,006,648 | 10/1961 | Devitt et al. | 273/406 |
| 3,382,821 | 5/1968 | Dundr | 109/82 |
| 3,404,886 | 10/1968 | Dundr | 273/410 |
| 3,404,887 | 10/1968 | Dundr | 81/34 |
| 3,614,102 | 10/1971 | Nikoden | 273/406 |
| 3,701,532 | 10/1972 | Nikoden | 273/406 |
| 3,737,165 | 6/1973 | Pencyla | 273/406 |
| 3,815,520 | 6/1974 | Nikoden | 273/406 |
| 3,815,914 | 6/1974 | Nikoden | 273/407 |
| 4,088,322 | 5/1978 | Nikoden | 273/406 |
| 4,247,115 | 6/1981 | Nikoden | 273/317 |

FOREIGN PATENT DOCUMENTS

| | | | |
|---|---|---|---|
| 635402 | 4/1950 | United Kingdom | 191/12 R |

*Primary Examiner*—Edward M. Coven
*Assistant Examiner*—Benjamin Layno
*Attorney, Agent, or Firm*—Niro, Scavone, Haller & Niro

[57] ABSTRACT

The present invention is directed to an automated target range system having a self-propelled carriage assembly that is moveable upon an overhead track that further provides a way to provide power and data information between the self-propelled carriage assembly and control units in order to efficiently operate the system individually or sequentially though a wide variety of operations that are necessary in today's target ranges.

12 Claims, 2 Drawing Sheets

FIG. 4
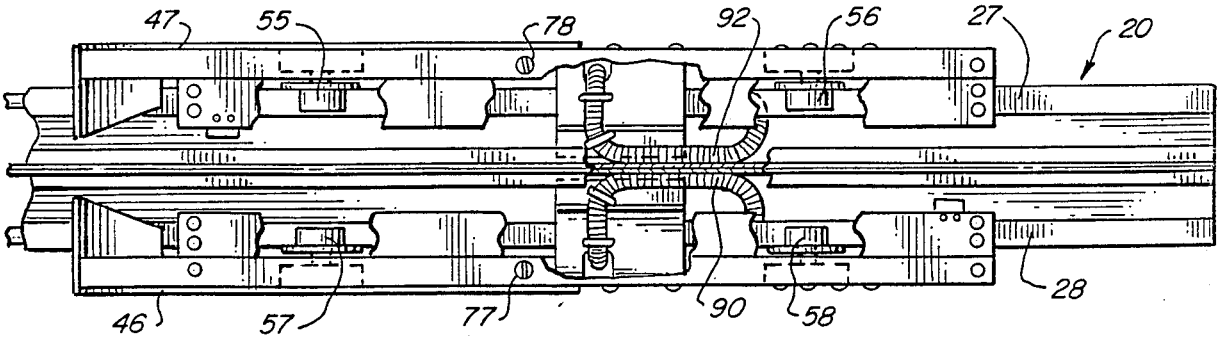
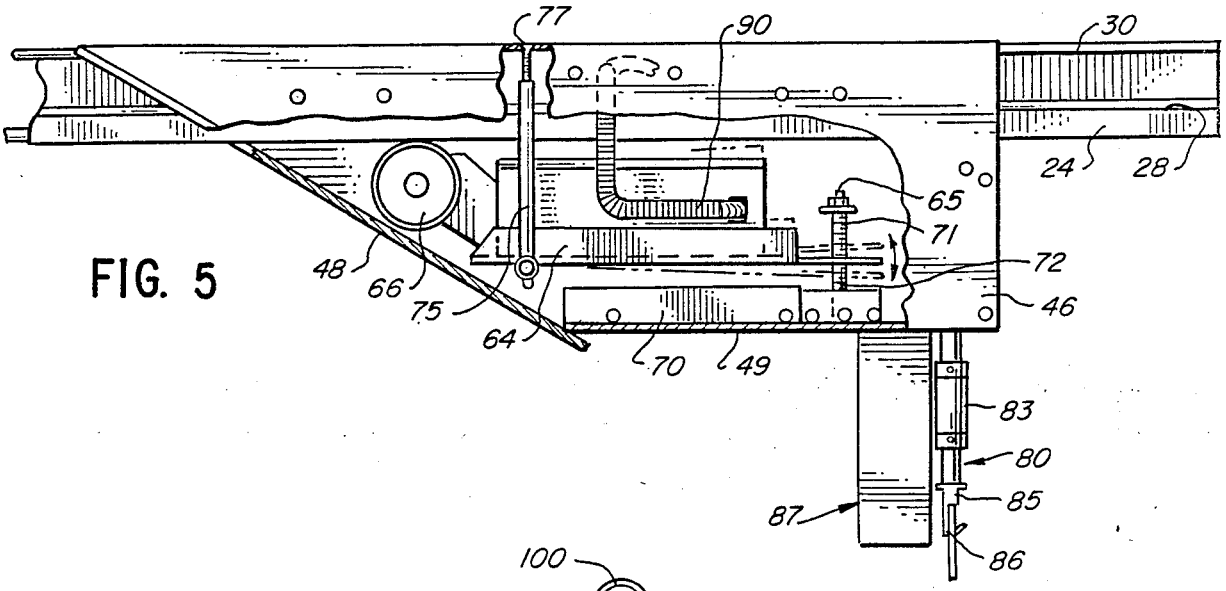
FIG. 5
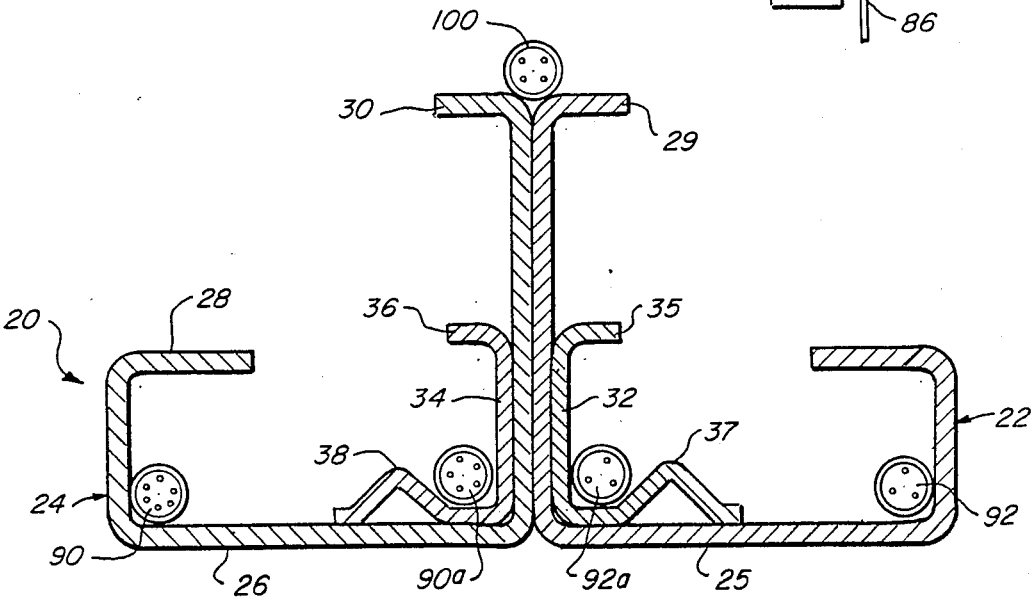
FIG. 3

AUTOMATED TARGET RANGE SYSTEM

BACKGROUND OF THE INVENTION

The invention relates generally to automated target range systems and more particularly to automated target range systems having self-propelled carriage assemblies which are selectively and independently controllable.

There are many automated target range systems presently in use which incorporate an overhead track to support a carriage. This carriage in turn supports a target for use in a shooting range. Some of these carriage assemblies include a target turning device to rotate the target 90° about a vertical axis. This target turning device enables the systems to be used in law enforcement firearms training courses with timed shooting events. However, because of the structure of the prior art devices, they are subject to high maintenance cost, high down time and are less flexible in the manner of operation and control.

For example, one such device is disclosed in U.S. Pat. No. 3,614,102. This automated target range system discloses a carriage that is mounted on an overhead track that extends longitudinally away from the shooter. The target carriage is pulled along the track by a steel puller cable, takeup pulley and drive motor arrangement. The steel puller cable is also an electrical conductor which provides power to the target turning device. However, because this arrangement uses plastic insulators and pulleys, the maintenance costs and down time are substantial.

Other prior art devices utilize similar cable and pulley systems in order to move the carriage along a "V" shaped track. In some, electrical power is provided to the target turning device via a driveable carbon brush, track insulator and take-up pulley arrangement. In others, power is provided to the target turning device via an externally exposed electrical bar. These devices suffer from high maintenance cost and high down time because of bullets damaging plastic pulleys and electrical shorts caused by ammunition casings and lead particles touching the electrified puller cable or electrical bar in the track cavity.

With the prior art devices, the target holders are typically metallic and subject to damage from bullets striking the surface. The prior target holders are also prone to cause misdirected or late shots to return to the area of the shooter. And the prior art devices that utilize steel puller cable and pulley devices, individual system and target status data cannot be transmitted from the carrier and displayed at a central control location. Similarly, with these devices, there is a limit to the number of units that can be operated sequentially, if at all. Further, these prior systems are unable to accept different operational programs for various courses and levels of firearms training.

SUMMARY OF THE INVENTION

The present invention is directed to an improved automated target range system which overcomes the disadvantages of existing systems, while at the same time providing advantages, such as increased flexibility in the manner of operation and control, as well as reduced costs of construction and maintenance.

Therefore, an object of the present invention is to provide an automated target range system having a self-propelled carriage assembly.

Another object of the present invention is to provide an automated target range system that is computer controlled for accurate operation and enables simultaneous or independent operation of a multiplicity of self-propelled carriage assemblies.

A further object of the present invention is to provide an automated target range system that can be controlled and monitored from a central station.

An additional object of the present invention is to provide a self-propelled carriage assembly that includes a way of providing power from a controller source to the carriage through a flexible conduit attached to the carriage, moving in a track cavity along with the carriage, as the carriage moves back and forth longitudinally on the track.

Yet a further object of the present invention is to provide a self-propelled carriage assembly that includes a way of providing a data link to the controller source through a flexible conduit attached to the carriage and moving in the track cavity along with the carriage, as the carriage moves back and forth longitudinally on the track.

Yet an additional object of the present invention is to provide a self-propelled carriage assembly that includes a nonmetallic target holder.

Still another object of the present invention is to provide an automated target range system that is low in construction, installation and maintenance costs.

In accordance with the present invention, an automated target range system is provided having a self-propelled carriage assembly being capable of independent and selective control and which is protected from bullet or lead particle interference while in operation.

In a preferred embodiment of the present invention, an automated target range system is provided having at least one longitudinally extending support track upon which a carriage assembly is propelled by a carriage drive assembly. The carriage assembly also includes a target positioning assembly. All of these assemblies are contained in the housing assembly of the carriage assembly. Further included is a power conduit located within the track for transmitting power from a power source. The power conduit is fixed at one end and connected at the other end to the carriage assembly and moveable with the carriage assembly along the support track. A data conduit is also provided and located within the track for transmitting information and signals between a controller and the carriage assembly. One end of the data conduit is fixed to the controller and the other end is connected to the carriage assembly and moveable with the carriage assembly along the support track. The present invention further includes guide assemblies within the track for positioning the power and data conduits and retention assemblies within the track for retaining the power and data conduits within the guide

BRIEF DESCRIPTION OF THE DRAWINGS

Further objects, features and advantages of the present invention, together with the organization and manner of operation, will become apparent from the following detailed description of the invention, when taken in conjunction with the accompanying drawings, wherein like reference numerals designate like elements throughout the several views.

FIG. 3 is a cross-sectional view of the track assembly taken along line 3—3 of FIG. 2.

FIG. 4 is a top plan view of the self-propelled carriage assembly with portions removed to reveal the inner components.

FIG. 5 is a side plan view of the self-propelled carriage assembly with portions removed to reveal the inner components.

FIG. 6A and 6B are top plan views of the track assembly showing the movement of the power and data conduits.

DETAILED DESCRIPTION OF THE PREFERRED EMBODIMENT

Figure 1:
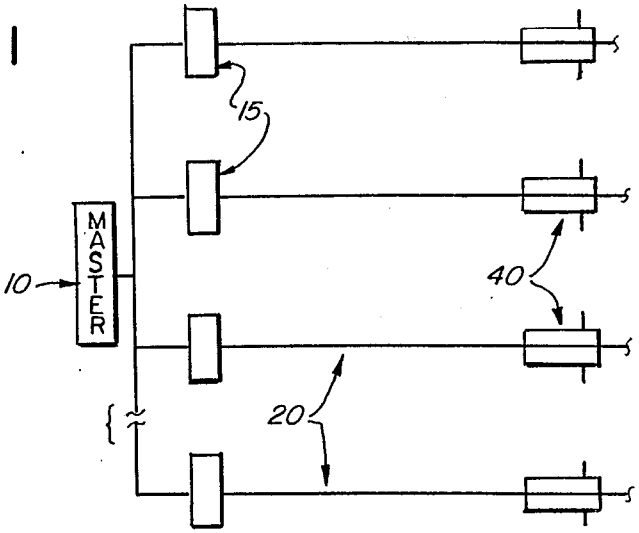
FIG. 1 is a block diagram of the target range system of the present invention.

The automated target range system of the present invention is shown schematically in the block diagram in FIG. 1. The system consists of a master control unit 10 which has the ability to control a plurality of individual control units 15. Each individual control unit 15 controls a self-propelled target carriage assembly 40. Each of the self-propelled target carriage assemblies 40 is supported by and moveable along a support track assembly 20. The self-propelled carriage assembly further consists of a housing assembly 45, a drive train assembly 60 and a target positioning assembly 80 (see FIG. 2).

To best understand the present invention, the support track 20 will be described initially since the other components of the system are generally supported by and operable upon the structure. Thereafter, the other components of the system will be described, as well as the final operational characteristics of the entire system.

Figure 2:
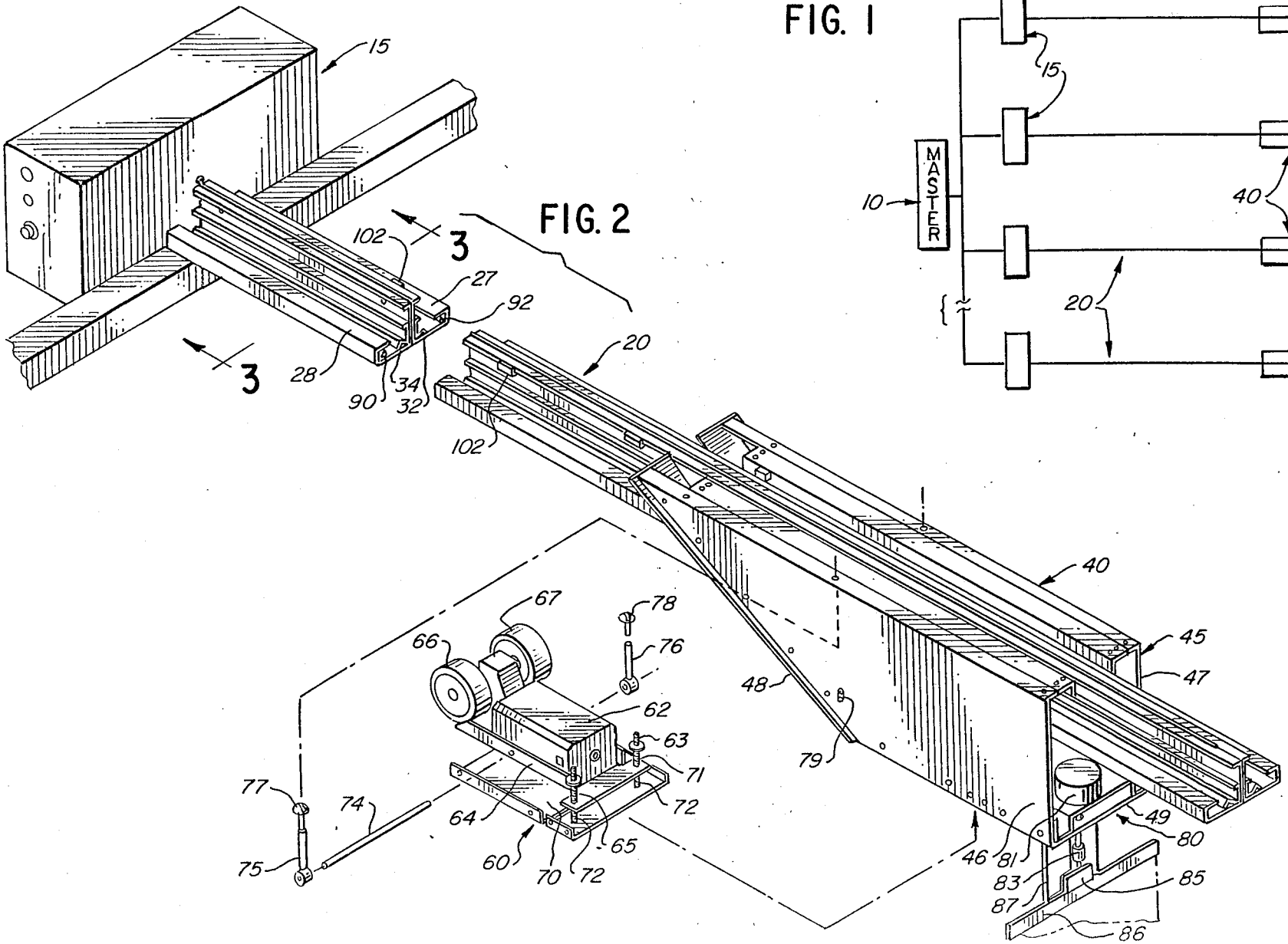
FIG. 2 is a perspective view of the device according to the present invention having an exploded view of the drive train assembly.

With reference to FIG. 2, the support track is shown generally as 20. It will be understood by those of skill in the art that the track 20 can be any length consistent with the requirements of the particular target range which employs the system. The track 20 is generally supported overhead and extends longitudinally away from the shooter from the individual control unit 15 to a free end.

A cross section of the support track 20 can best be seen with reference to FIG. 3. The support track 20 is constructed from two generally J-shaped channels 22 and 24 (hereinafter referred to as right channel 22 and left channel 24). Right channel 22 and left channel 24 are rigidly secured together (for example, by a weldament or bolts), back to back on the generally vertical plane. Both the right 22 and left 24 channels have a drive surface 25 and 26, respectively, as well as a generally parallel riding surface 27 and 28 which ar constructed from the flanges of right and left channels 22 and 24. It will be understood by those of skill in the art that the size and depth of the channels must be sufficient to support the self-propelled carriage assembly 40, as well as the other elements of the system as hereinafter described. Additionally, each of the generally J-shaped channels 22 and 24 provide an upper support flange 29 and 30. These support flanges 29 and 30 provide a means to attach the track 20 throughout its length to any suitable overhead structure (not shown).

Nested within the bottom of right channel 22 and left channel 24 are plastic extrusions 32 and 34 which are secured throughout the length of track 20. Each of these extrusions 32 and 34 have an upper constraint flange 35 and 36. The extrusions 32 and 34 also have a ridge portion 37 and 38. The extrusions 32 and 34 are nested along the length of the right and left channels 22 and 24 along the inside flange of J-shaped channels. The function of these extrusions will be hereinafter described. Generally, however, the area below riding surfaces 27 and 28, ridge portions 37 and 38 and above the drive surfaces 25 and 26 in conjunction with the extrusions 32 and 34 receive a power conduit 90 and a data conduit 92 as the carrier 40 travels along the length of track 20 as hereinafter described. In this manner, the extrusions 32 and 34 generally serve to guide the power and data conduits 90 and 92 as the carriage 40 moves along track 20. And the ridge portions 37 and 38 operate to retain and guide the power and data conduits 90 and 92.

With reference to FIGS. 2, 4 and 5, the self-propelled carriage assembly 40 can best be understood. Target carriage assembly 40 consists of three operational assemblies. As can be seen in FIG. 2, the operational assemblies include a housing assembly 45, a drive train assembly 60, and a target positioning assembly 80.

The housing assembly 45 is constructed of frontal armor sufficient to withstand the impact of any ammunition used within the range. It consists of two side plates 46 and 47, a front armor plate 48, a bottom plate 49 and a rear plate (not shown). The side plates 46 and 47 are of such a shape that the front armor plate 48 is inclined on a downward angle. In this manner, should a misdirected bullet hit the front plate, it will be deflected downward so as to not harm the carrier 40. The general shape and construction of the housing assembly 45 will be well known to those of skill in the art is, thus, only briefly described.

The carriage assembly 40 is suspended from and moveable along the length of the track assembly 20. With reference to FIG. 4 the assembly is supported by and rollable upon track 20 by the use of four flanged free wheels 55, 56, 57 and 58. Free wheels 55 and 57 are rotatably secured to side plates 47 and 46, respectively, of the carrier housing 45 toward the front of said housing. Similarly, free wheels 56 and 58 are rotatably secured to side plates 47 and 46, respectively. It is well known by those of skill in the art that the free wheels 55, 56, 57 and 58 are rotatable on a shaft (shown in phantom line) and affixed to the side plates 46 and 47 such that the wheels are not obstructed by the housing assembly 45. Free wheels 55 and 56 ride along and contact the riding surface 27 of the right channel 22. Similarly, free wheels 57 and 58 ride along and contact the riding surface 28 of left channel 24. In this manner, the self-propelled carrier 40 is movable along the length of the track assembly 20 with the remainder of housing assembly 45 suspended below the track.

The carriage assembly 40 is self-propelled through the use of a drive train assembly 60. Again with reference to FIG. 2, the drive train assembly 60 consists of an electric D.C. motor 62 mounted on a plate 64 with two right angle output shafts. The output shafts drive a pair of elastomeric drive rollers 66 and 67 which are spaced so as to contact the drive surfaces 25 and 26 of right and left channels 22 and 24. Thus, the riding surfaces 27 and 28 and the drive surfaces 25 and 26 of the right and left channels 22 and 24 are sandwiched between the drive wheels 66 and 67 and free wheels 55, 56, 57 and 58. In this manner, carrier assembly 40 is propelled.

The drive train assembly 60 is also provided with a biasing means, which in this embodiment is composed of a shock absorber assembly, as well as an adjustment mechanism to adjust the pressure with which the drive wheels 66 and 67 contact the drive surface 28 and 27 of right and left channels 22 and 24. With reference to FIGS. 2 and 5, this feature is accomplished by providing a lower plate 70 which is connected to the motor mounting plate 64 by two posts 63 and 65, each supporting an upper spring 71 and a lower spring 72. Motor mounting plate 64 is sandwiched at one end between the upper spring 71 and lower spring 72 upon each of the posts 63 and 65. Lower plate 70 is then secured to the bottom plate 49 of armored housing 45. Bottom plate 49 also protects the drive train assembly from stray bullets or bullet particles. It will be understood by those of skill in the art that the biasing means can take many embodiments consistent with the present invention by the use of springs, posts, washers, bolts and other mechanical components commonly known.

At the front end of the motor mounting plate 64, a rod 74 is provided which is of sufficient length to accommodate the width between side plates 46 and 47. The rod 74 is transverse to the carrier housing 45, supports the front end of the motor mounting plate 64 and is provided vertical guidance by slots 79 in side plates 46 and 47. The transverse rod 70 is adjustably connected to the top of carrier housing assembly 45 by the use of tie rods 75 and 76 which extend vertically upward to the top of housing assembly 45. The pressure is then adjustable by the use of two screws 77 and 78 which operate within tie rods 75 and 76 and which are accessible through the top of the housing assembly 4 (see FIG. 4). In this manner, the pressure with which drive wheels 66 and 67 contact the drive surfaces 28 and 27 can be selected. Also, the movement of motor mounting plate 64 about the rod 70 and the teeter-totter effect produced with the springs 71 and 72 enables efficient operation of the device even if the track assembly 20 has imperfections or undulations along its length with this biasing system which also absorbs the torque associated with the starting and stopping of motor 62.

With reference to FIG. 2, housed within and supported by the carrier housing assembly 45, is a target positioning assembly shown generally as 80. The target positioning assembly 80 consists of a stepper motor 81, a vertical shaft 83 and a target holding device 86. The electric stepper motor 81 is housed in the rear of the housing assembly 45 with its generally vertical shaft 83 protruding downward through the bottom plate 49. Attached to the vertical shaft 83 is a clamping device 85 which holds a target holder device 86. This target holder 86 is preferably of a material that will permit a bullet to penetrate in order to prevent the possibility of a ricochet. As can best be seen in FIG. 5, a protective plating 87 is also provided. The protective plating 87 is affixed to the bottom plate 49 of housing assembly 45 and positioned in front of the generally vertical shaft 83 of target positioning assembly 80. In this manner, the assembly 80 is protected from damage from a misdirected bullet. When in operation, the target positioning assembly 80 allows the target holder 86 to be rotated 360°. In this fashion, different targets can be provided on either side to test the reflexes and decision making ability of the target range user.

The drive assembly 60 and the target positioning assembly 80 are controlled and powered through the use of a power conduit 90 and data conduit 92. The power conduit 90 and the data conduit 92, in the preferred embodiment, are constructed from flexible coils which have inside them wires to transfer power and data. The coils operate to protect the wires from damage. The power and data conduits 90 and 92, which are of fixed length depending upon the requirements of the particular target range and the length of track 20, are physically and electrically connected between the controller 15 and the carrier assembly 40. Starting at the controller 15, the power conduit 90 is placed under the riding surface 28 of left channel 24. In a similar manner starting at the controller 15 the data conduit 92 is placed under the riding surface 27 of right channel 22. At a point where the self-propelled carrier assembly 40 is at its maximum distance away from the shooter the ends of both coils are turned 180° (so that the ends now point to the controller 15) and the ends are placed in the extrusion cavities 34 and 32 and the power and data conduits 90 and 92 ends connected to the carrier assembly 40 in a manner that will be apparent to those of ordinary skill in the art. The power and data wires in the power and data conduits 90 and 92 are then connected to the drive motor 62, stepping motor 81 and the other sensors as required for operation and as hereinafter described. In this manner, the self propelled target carrier assembly 40 can be operated through the host computer 10 or optional individual micro-computers (not shown). Thus, when installed in this configuration, one portion (the major portion) of power and data conduits 90 and 92 is positioned under riding surfaces 28 and 27, respectively, and another, smaller portion (i.e., until operation of carriage assembly 40) of power and data conduits 90 and 92 is positioned within extrusion cavities 34 and 32, respectively. When so installed, an intermediate portion of power and data conduits 90 and 92 crosses over guide and retention means 38 and 37 forming a loop which moves with the carriage assembly 40 when operated as hereinafter described.

Now with reference to FIGS. 2–4, the operation of the device will be understood. When the self-propelled target carriage assembly 40 is furthest from the shooter, the power and data conduits 90 and 92 are positioned as shown in FIG. 3 (power and data conduits **90*a* and 92*a* as shown in FIG. 3 are only present after the carriage assembly 40 is activated and driven towards the shooter as hereinafter described). As the self-propelled target carriage assembly 40 is activated and driven towards the shooter, the portion of power and data conduits 90 and 92 respectively, moving within the plastic extrusion cavities 34 and 32, become longer and the length of the power and data conduits 90 and 92 respectively, lying under the riding surfaces 28 and 27, decreases. Thus, the length of power and data conduits 90 and 92 is constant, only the portion of each conduit riding within extrusion cavities 34 and 32 and the portion riding under riding surfaces 28 and 27 changes as the carriage assembly 40 is activated and moved along track 20. Notably, because of the manner in which the power and data conduits 90 and 92 are looped, (i.e., over ridge portions 38 and 37 and the ends of conduits 90 and 92 turned back towards and attached to the controller 15), as the self-propelled target carriage assembly 40 is driven towards the shooter, the moving loop of the power and data conduits 90 and 92 rides along the restraining or top ridges 38 and 37 of extrusions 34 and 32 and the coils 90 and 92 are guided into and nest in the cavities of extrusions 34 and 32. In FIG. 3 as the target carriage assembly 40 is retracted toward the shooter and as the conduits act as described above, the rearward portion of the power conduit 90 becomes nested within the extrusion 34 and is indicated as 90***a*. In the same manner, and in equal proportion the data conduit 92 becomes nested within extrusion 32 and is indicated as 92*a*. Thus, the conduits are operably and safely housed within track 20. Upon movement away from the shooter, the above-described operation is reversed, with the retention means 37 and 38 serving as a retainer and a divider.

Additionally, protection is provided so that the power and data conduits 90 and 92 will not be able to pop-out of the track assembly 20. This protection is provided by the flanges which establish the riding surface 27 and 28 for the flanged free wheels 55, 56, 57 and 58 and by the extrusion flanges 35 and 36. Thus, no matter what position along track 20 the self propelled target carriage assembly 40 is in, the possibility that the conduits will leave the track assembly 20 is minimized, thereby reducing the risk of damage to the power and data conduits 90 and 92 by either misdirected bullets or the self-propelled target carriage assembly 40.

A sensor cable 100 is also provided (see FIG. 3) which is connected to controller 15. Along the length of track 20 and connected to the support flanges 29 and 30 are stationary sensors 102 (see FIG. 2), which are operably connected to sensor cable 100. Housed within the carrier housing 45 and operably connected to the data conduit 92 are moveable sensors 105. The stationary sensors 102 are evenly spaced along track 20. In this manner, as the carriage moves along track 20, moveable sensors 105 periodically contact stationary sensors 102. Thus, through the interconnection with the control units 15 and the master control 10, the position of the carriage 40 can be accurately determined.

In other embodiments of the present invention, the power and data conduits 90 and 92 can be combined in the same coil, thus requiring only a single conduit. In this embodiment, it is not necessary to have two channels in the track 20 to operably house the conduit, since only one would be required. Additionally, the support track 20 may itself be a single extrusion or other suitable construction.

It will also be understood by those of skill in the art that there are a variety of materials that are suitable for use in the present invention. For example, the drive wheels can be constructed of a rubber or plastic material as long as it is suitable to propel the carriage assembly 40. And in the preferred embodiment the extrusions 32 and 34 (or guide and retention means) are an ABS plastic material. However, any similar material which has a low coefficient of friction, is of sufficient rigidity for the stated purpose and is sufficiently durable so as to have a long useful life may be used.

The sensing system can also take on other embodiments. For example, the stationary sensors 102 can be magnets and the moveable sensors 105 in the housing assembly 45 can be a reed switch. In this embodiment, as the carriage 40 moves along track 20, the stationary sensors 102 close the moveable sensors 105 and the information is then conveyed to the control units 15. In this embodiment, there is no need for the sensing cable 100 as shown in FIG. 3.

Additionally, individual micro-computers can be utilized in conjunction with the master control unit 10 and individual control units 15 to help enhance the flexibility and controllability of the operation of the present invention.

While preferred embodiments of the present invention have been illustrated and described, it will be understood that changes and modifications can be made without departing from the invention in the broader aspects. Various features of the invention are set forth in the following claims.

What is claimed is:

1. A target range system, comprising:

at least one longitudinally extending support track;

a carriage assembly movable along said support track and including a housing, carriage drive means and target positioning means; and power conduit means located within said track for transmitting power from a power source at one end of said track to said drive means, said power conduit means having a first end connected in fixed position to said power source and a second end connected to and movable with said carriage assembly along said support track, said power conduit means maintaining proper position and operability within said support track.

2. The target range system of claim 1 wherein said power conduit means also transmits information and control signals between said one end of said track and said carriage assembly.

3. The target range system of claim 1 wherein said support track includes guide means for properly positioning said power conduit means within said track.

4. The target range system of claim 1 wherein said support track includes retention means for retaining said power conduit means within said track.

5. The target range system of claim 1 further including longitudinally extending guide means positioned within said track to properly position and retain said power conduit means within said track.

6. The target range system of claim 5 wherein said channel member is constructed of a material having a low coefficient of friction.

7. The target range system of claim 1 wherein said drive means comprises an electric motor and at least one drive roller in operative engagement with said track and driven by said motor; said motor and said drive roller being enclosed within said housing.

8. A target range system, comprising:

at least one longitudinally extending support track;

a carriage assembly moveable along said support track and including a housing, carriage drive means and target positioning means;

power conduit means located within said track for transmitting power from a power source at one end of said track to said drive means, said power conduit means connected in fixed position to said power source and a second end connected to and moveable with said carriage assembly along said support track; and data conduit means for transmitting information and control signals between a controller at said one end of said track and said carriage assembly, said data conduit means having a first end connected in fixed position to said controller and a second end connected to and moveable with said carriage along said support track.

9. A target range system, comprising:

at least one longitudinally extending support track;

a carriage assembly moveable along said support track and including a housing, carriage drive means and target positioning means;

power conduit means located within said track for transmitting power from a power source at one end of said track to said drive means, said power conduit means connected in fixed position to said power source and a second end connected to and moveable with said carriage assembly along said support track; and a longitudinally extending guide means positioned within said track to properly position and retain said power conduit means within said track, said guide means being a channel member having a divider means for positioning a portion of said power conduit on one side of said guide means and a second portion of said power conduit on the other side of said guide means with an intermediate portion of said power conduit crossing said divider means.

10. The target range system of claim 1 further including stationary sensors positioned along said support track and moving sensors mounted to said carriage assembly, said stationary and moving sensors generating data signals to determine the location of said carriage on said support track.

11. A target range system, comprising:

at least one longitudinally extending support track;

a carriage assembly moveable along said support track and including a housing, carriage drive means and target positioning means;

power conduit means located within said track for transmitting power from a power source at one end of said track to said drive means, said power conduit means connected in fixed position to said power source and a second end connected to and moveable with said carriage assembly along said support track, said power conduit means including an external, spiral wound coil casing providing both flexibility and sufficient longitudinal rigidity to maintain said power conduit means in proper position within said support track.

12. A target range system, comprising:

at least one longitudinally extending support track;

a carriage assembly moveable along said support track and including a housing, carriage drive means and target positioning means wherein said drive means provides an electric motor and at least one drive roller in operative engagement with said track and driven by said motor, said motor and said drive roller being enclosed within said housing;

a biasing means for maintaining said drive roller in driving engagement with said support track, and means for adjusting the position of said drive roller relative to said support track; and power conduit means located within said track for transmitting power from a power source at one end of said track to said drive means, said power conduit means having a first end connected in a fixed position to said power source and a second end connected to and moveable with said carriage assembly along said support track.

* * * * *